US007971739B2

(12) United States Patent
Ammann

(10) Patent No.: US 7,971,739 B2
(45) Date of Patent: Jul. 5, 2011

(54) CLOSURE

(75) Inventor: Rainer Ammann, Bobingen (DE)

(73) Assignee: Rainer Ammann, Bobingen (DE)

( * ) Notice: Subject to any disclaimer, the term of this patent is extended or adjusted under 35 U.S.C. 154(b) by 388 days.

(21) Appl. No.: 12/089,426

(22) PCT Filed: Oct. 5, 2006

(86) PCT No.: PCT/EP2006/009649

§ 371 (c)(1),
(2), (4) Date: Jul. 28, 2008

(87) PCT Pub. No.: WO2007/042204

PCT Pub. Date: Apr. 19, 2007

(65) Prior Publication Data

US 2009/0026165 A1 Jan. 29, 2009

(30) Foreign Application Priority Data

Oct. 7, 2005 (DE) ..... 10 2005 048 521

(51) Int. Cl.
*B65D 41/56* (2006.01)
*B65D 17/42* (2006.01)
*B65D 41/00* (2006.01)

(52) U.S. Cl. ..... 215/257; 220/212; 220/254.9; 220/277; 215/227; 215/250; 215/258; 215/DIG. 8; 222/81; 222/83; 222/525

(58) Field of Classification Search ..... 220/212, 220/254.9, 277; 215/227, 250, 257, 258, 215/DIG. 8; 222/81, 83, 525
See application file for complete search history.

(56) References Cited

U.S. PATENT DOCUMENTS

| | | | | |
|---|---|---|---|---|
| 5,141,133 | A * | 8/1992 | Ninomiya et al. | 222/83 |
| 5,992,692 | A | 11/1999 | Boissay | |
| 6,000,578 | A | 12/1999 | Boissay | |
| 6,477,743 | B1 * | 11/2002 | Gross et al. | 222/525 |
| 6,702,161 | B2 * | 3/2004 | Adams et al. | 222/521 |
| 6,959,839 | B2 * | 11/2005 | Roth et al. | 222/83 |
| 2004/0208960 | A1 | 10/2004 | Marshall | |
| 2008/0124432 | A1 * | 5/2008 | Ma | 426/115 |

FOREIGN PATENT DOCUMENTS

| | | | |
|---|---|---|---|
| GB | 2405868 | A | 12/2003 |
| JP | 11-29180 | | 7/1997 |
| WO | W003/093128 | A1 | 11/2003 |
| WO | WO2004/113184 | | 12/2004 |
| WO | W02006/099768 | A1 | 9/2006 |

* cited by examiner

*Primary Examiner* — Anthony Stashick
*Assistant Examiner* — Madison L Wright
(74) *Attorney, Agent, or Firm* — Brooks Kushman P.C.

(57) ABSTRACT

A closure for a container with a cap connecting to a neck of the container has at least one cutter edge placed around a central axis internal of the neck. The edge cuts through a closure film as axially displaced on a holding sleeve, which is held centrally by the cap with a flexible skirt. The holding sleeve contains a component for mixing with the contents of the container. A screw cap holds an initial non-puncturing position and, a stop position after additional screwing on, at which the film is punctured. The cap remains permanently on the neck of the container, and includes a pouring opening. In the stop position, the container contents flow toward the pouring opening. When the screw cap is back into its initial position, flow to the pouring opening is interrupted.

24 Claims, 8 Drawing Sheets

CLOSURE

The invention relates to a closure for a container having contents, particularly a bottle or the like made of plastics material, glass or the like, comprising a cap, particularly of plastics material, to be sealingly connected to a neck of the container, which neck has a rim, and comprising at least one knife edge disposed in the region of the inside width of the neck around the center axis of the cap for severing a sealing film or foil upon axial displacement of the at least one knife edge through the sealing film or foil, which knife edge is disposed on a receptacle held substantially centrally by the cap via a flexible apron and is movable relatively to the cap toward the sealing film or foil, which receptacle contains an ingredient to be mixed with the contents of the container, and further comprising a central union, having a male thread, on an upper transverse wall of the cap and a screw cap that can be screwed down onto, and unscrewed up from, the same by means of actuating means disposed on its inside end face, by means of which, when the screw cap is screwed onto the central union, the receptacle with its at least one knife edge can be moved toward the sealing film or foil, which screw cap has an initial screwing position in which the sealing film or foil is still intact and, after continued screwing, a final screwed position in which the sealing film or foil has been pierced by the at least one knife edge.

Such closures serve to keep an ingredient of the container's contents separate from the main component thereof during a waiting or storage time until the time of usage has arrived, particularly to avoid premature impairment of the quality or usability of the entire contents as might occur with time after mixing due to aging or the like. In the case of beverages or foodstuffs in general this is simply the time when the user wishes to consume the contents of the container or bottle, while in the case of, for example, chemicals, paints, enamels, cleaning agents, etc. it is the time when they are to be used. In the case of foodstuffs, the component to be mixed in may consist of, for example, vitamins or mixtures thereof and in the case of paints or plastics, of activators such as pigments or accelerators (e.g. oxidizing agents), etc.

A closure of this type is disclosed in WO 2004/113 184 A-2, in which case the cap is designed as a first screw cap and the screw cap as a second screw cap. After the sealing film or foil has been opened and the ingredient to be mixed into the contents of the container has been released, this prior closure, i.e. the first screw cap together with the second screw cap, must be completely unscrewed from the neck of the container when it is desired to withdraw some of the mixed contents of the container. When it is desired to re-close the container after partially removing the contents of the container, it is necessary to screw the closure back on again as a whole. Thus, when unscrewing and removing the contents of the container, e.g. when drinking from a bottle if it contains a beverage, and when the cap is to be screwed back on for the purpose of re-closing the container or bottle, the user has to use both hands, at which time there is always the risk, due to the removal of the cap from the container or bottle, of the cap dropping out of the hand of the user or drinker.

In addition, closures known as so-called sports caps are known which have to be only partially unscrewed in order to remove the container's contents, i.e. they can remain on the neck of the container or bottle, because such a sports cap has an outlet opening which is opened even when only partially unscrewed and can be re-closed by rescrewing. Such sports caps permit an athlete, particularly a cyclist, to drink during sports activity without having to use both hands and without risking the loss of the closure of the bottle when so doing.

The object of the invention is to provide a closure of the type mentioned above designed in a way that is suitable for fulfilling the functions of a sports cap.

A first solution to this problem consists in that a) the cap remains on the neck of the bottle after it has been sealingly connected thereto,
b) the screw cap has a decanting and/or drinking opening of the sports cap type,
c) at least one first axial passageway for the contents of the bottle is provided radially between the first cap and the receptacle,
d) the receptacle is guided in a sliding manner centrally in a coaxial guide in the transverse wall of the cap, which initially bears axially against a substantially radial inside surface of the cap, the receptacle, by bearing against the cap, providing a seal between the container and the screw cap and thus the environment, and when it moves with its at least one knife edge concentrically relatively to the sealing film or foil to an end position, it is capable of severing the sealing film or foil, and in this end position the sealing film or foil has been at least partially severed, the ingredient to be mixed in has been released into the contents of the bottle, and another passageway has been opened between the receptacle and the cap,
e) the screw cap, on its inside covering surface, and the receptacle, on its end face opposite thereto, together comprise, as actuating means, a concentric connecting pair consisting of a plunger and a counterpart mating therewith, which interengage axially immovably, the plunger and its counterpart being positioned axially relatively to each other such that, by said continued screwing of the screw cap on the central union to the final screwed position, the container's contents can be released to flow to the screw cap and its decanting and/or drinking opening, this being achieved by the receptacle being moved, during such continued screwing, toward the sealing film or foil to cause the at least one knife edge to pass through the sealing foil or film to break the seal between it and the cap, and
f) when the screw cap is turned in the reverse direction, i.e., back to its initial screwing position, the receptacle can be moved by the actuating means back to its sealing position against the cap such that the passageway to the screw cap and its decanting opening is again blocked.

According to the invention, after mixing of the ingredient to be mixed in has taken place, the closure does not have to be completely removed in order to withdraw at least some of the mixed contents of the container and does not have to be laboriously replaced for the purpose of closing the container and sealingly connecting it to the neck of the container, as is the case with the prior art elaborated above, where the entire closure has to be screwed on again after it has been opened by being completely unscrewed. By contrast, in the case of the subject matter of the invention, the cap remains on the neck and partial screwing of the screw cap toward its final screwed position to break the above-described seals is sufficient to permit the contents of the container to be decanted. This is particularly advantageous in the case of foodstuff or beverage bottles during athletic events such as cycling.

A second solution to the problem of the invention consists in that a) the cap remains permanently on the neck of the bottle after it has been screwed on,
b) the screw cap has a decanting and/or drinking opening of the sports cap type,
c) at least a first passageway for the contents of the bottle is provided radially between the cap and the receptacle, d) an axial intermediate piston is centrally provided initially bearing against a substantially radial inside surface of the cap between the cap and the receptacle and is movably guided in a coaxial guide in the transverse wall of the cap, which intermediate piston is capable, by bearing against the cap, of forming a seal between the container and the screw cap and thus the environment, and on the other hand, as it moves jointly with the receptacle, of moving the same and its at least one knife edge concentrically relatively to the sealing film or foil to an end position for the purpose of severing the sealing film or foil, in which end position the sealing film or foil has been at least partially severed, the ingredient has been released into the bottle's contents, and another passageway between the intermediate piston and the cap has been opened, e) the screw cap, on its inside covering surface, and the intermediate piston, on its end face opposite thereto, together comprise, as actuating means, a concentric connecting pair consisting of a plunger and a counterpart mating therewith, which interengage axially immovably, the plunger and its counterpart being positioned axially relatively to each other such that, by said continued screwing of the screw cap on the central union to the final screwed position, the container's contents can be released to flow to the screw cap and its decanting and/or drinking opening, this being achieved by the intermediate piston being moved, during such continued screwing, toward the sealing film or foil to break the seal between it and the cap and thus to cause the at least one knife edge to pass through the sealing foil or film, and f) when the screw cap is turned in the reverse direction, i.e., back to its initial screwing position, the intermediate piston can be moved by the actuating means back to its sealing position against the cap such that the passageway to the screw cap and its decanting opening is again blocked.

This second solution differs from the aforementioned first solution essentially in the fact that the actuating means and the receptacle are designed as two separate parts. At the same time, on the counterpart of the actuating means the rod extension comprising the coupling sleeve is designed as a piston at its end facing the receptacle. This piston is referred to below as the intermediate piston, since it is disposed between the receptacle and the opposing end face of the first screw cap. The receptacle may in this case have a flat end face as an axial bearing surface for the intermediate piston, against which the intermediate piston can bear and entrain the receptacle, as soon as the screw cap, upon continued screwing on the central union, moves or pushes the receptacle in the opening direction for the purpose of piercing the sealing film or foil.

At first glance, this second solution may appear to be more complicated, more costly and therefore less advantageous due to splitting the design of the receptacle and actuating means, which are present as one piece in the first embodiment. However, this second solution has two important advantages over the first solution:

1. This second solution can be produced and assembled at lower cost. On the one hand, the receptacle and intermediate piston as relatively simply shaped parts can each be produced in a relatively simple manner. On the other hand, the ingredient to be accommodated by the receptacle and later mixed in can be inserted and enclosed by the sealing film or foil while the receptacle is lying on its substantially flat back, e.g., on an assembly line.

2. In both the first and the second embodiment, when the second screw cap is screwed to its final screwed position for the purpose of piercing the sealing film or foil and possibly also the foil seal, the flexible apron is deformed, which is, of course, adapted to permit the receptacle to be moved or displaced in the required manner. It is to be understood that this apron, regardless of its flexibility of deformation, asserts a certain though not very pronounced degree of resistance. If, then, the closure according to the invention is re-closed by screwing the second screw cap in the reverse direction, i.e. back to its initial screwing position, then in the first embodiment, the receptacle must also be entrained during the corresponding backward movement of the apron, while in the second embodiment, the receptacle can advantageously remain behind. Re-closing the container or bottle therefore requires less screwing effort, which is important with regard to the desired possibility of single-handed operation.

The sealing connection of the cap with the neck of the container can be achieved in various ways, e.g., by welding or gluing, etc. However, the most common method at present is to design the cap corresponding to the closest prior art mentioned above as a first screw cap, so that the above-mentioned screw cap becomes a second screw cap. The difference, of course, resides in the fact that in the above-described prior art according to the document cited, this first screw cap and therefore the entire closure must be unscrewed if it is desired to gain access to the contents of the container, while in the case of the subject matter of the invention, the cap, after being sealed to the neck of the bottle, can remain permanently thereon, particularly when it is designed as a first screw cap. If it has been welded on, sealed on, shrunk on, etc., its remaining thereon is a matter of course.

Therefore, the closure according to the invention is preferably designed such that the cap as a first screw cap has a sleeve section with a female thread adapted for screwing onto a male thread of a neck, having a rim, of a container, and the screw cap functions as a second screw cap.

Therefore the invention relates particularly to a closure having a first screw cap, particularly of plastics material, which has a sleeve section with a female thread for screwing onto a male thread on a neck, displaying a rim, of a container having contents, particularly a bottle or the like of plastics material, glass or the like, comprising at least one knife edge disposed in the region of the inside width of the neck around a center axis of the first screw cap for severing a sealing film or foil upon axial displacement of the at least one knife edge through the sealing film or foil, said knife edge being disposed on a receptacle held substantially centrally by the first screw cap via a flexible apron and capable of moving relatively to the first screw cap toward the sealing film or foil, which receptacle contains an ingredient to be mixed into the contents of the container, and comprising a central union, having a male thread, on an upper transverse wall of the first screw cap and a screw cap that can be screwed down onto, and unscrewed up from, the same with actuating means disposed on its inside end face, by means of which, when the screw cap is screwed onto the union, the receptacle with its at least one knife edge can be moved toward the sealing film or foil, this second screw cap having an initial screwing position, in which the sealing film or foil is still intact and, after continued screwing, a final screwed position, in which the sealing film or foil has been pierced by at least one knife edge.

Starting from this known design, the corresponding variant of the first solution to the problem of the invention consists in that a) the first screw cap remains permanently on the neck of the bottle after it has been screwed on, b) the screw cap has a decanting and/or drinking opening of the sports cap type, c) at least a first passageway for the contents of the bottle is provided radially between the first screw cap and the receptacle, d) the receptacle is guided in a sliding manner centrally in a coaxial guide in the transverse wall of the first screw cap, which initially bears axially against a substantially radial inside surface of the first screw cap, the receptacle providing, by bearing against the first screw cap, a seal between the container and the second screw cap and thus the environment, and when it is moved concentrically relatively to the sealing film or foil to an end position, it is capable of severing this sealing film or foil with its at least one knife edge, in which case, in said end position (FIGS. 3 and 4), the sealing film or foil has been at least partially severed, the ingredient to be mixed in has been released into the contents of the bottle and another passageway has been opened between the receptacle and the cap, e) the screw cap, on its inside covering surface, and the receptacle, on its end face opposite thereto, together comprise, as actuating means, a concentric connecting pair consisting of a plunger and a counterpart mating therewith, which interengage axially immovably, the plunger and its counterpart being positioned axially relatively to each other such that, by said continued screwing of the screw cap on the central union to the final screwed position, the container's contents can be released to flow to the screw cap and its decanting and/or drinking opening, this being achieved by the receptacle being moved, during such continued screwing, toward the sealing film or foil to break the seal between it and the cap and thus to cause the at least one knife edge to pass through the sealing foil or film, and f) when the screw cap is turned in the reverse direction, i.e., back to its initial screwing position, the receptacle can be moved by the actuating means back to its sealing position against the cap such that the passageway to the screw cap and its decanting opening is again blocked.

The corresponding variant of the second solution to the problem of the invention then consists in that a) the first screw cap remains permanently on the neck of the container after it has been sealingly connected thereto, b) the second screw cap has a decanting and/or drinking opening of the sports cap type, c) at least a first passageway for the contents of the bottle is provided radially between the first screw cap and the receptacle, d) an axial intermediate piston is provided centrally which initially bears against a substantially radial inside surface of the first screw cap between the first screw cap and the receptacle and is movably guided in a coaxial guide in the transverse wall of the first screw cap, said intermediate piston, by bearing against the first screw cap, being capable of forming a seal between the container and the screw cap and thus the environment and, on the other hand when it is moved jointly with the receptacle, of moving the same and its at least one knife edge concentrically relatively to the sealing film or foil to an end position for the purpose of severing the sealing film or foil, in which end position the sealing film or foil has been at least partially severed, the ingredient to be mixed in has been released into the bottle's contents and another passageway between the intermediate piston and the first screw cap has been opened, e) the second screw cap, on its inside covering surface, and the intermediate piston, on its end face opposite thereto, together comprise, as actuating means, a concentric connecting pair consisting of a plunger and a counterpart mating therewith, which interengage axially immovably, the plunger and its counterpart being positioned axially relatively to each other such that, by said continued screwing of the second screw cap on the central union to the final screwed position, the container's contents can be released to flow to the second screw cap and its decanting and/or drinking opening, this being achieved by the intermediate piston being moved, during such continued screwing, toward the sealing film or foil to break the seal between it and the cap and thus to cause the at least one knife edge to pass through the sealing foil or film, and f) when the second screw cap is turned in the reverse direction, i.e., back to its initial screwing position, the intermediate piston can be moved by the actuating means back to its sealing position against the cap such that the passageway to the second screw cap and its decanting opening is again blocked.

The neck of the container may initially be hermetically sealed by a foil seal which has been sealingly attached to a circular sealing surface on the rim of the neck and which upon movement of the second screw cap to its final screwed position, like the sealing film or foil, is penetrated by at least one knife edge on the receptacle.

It is of particular advantage if the male thread on the central union forms a quick thread with the thread of the second screw cap such that less than one turn of the second screw cap, in the one direction of rotation, is necessary to open the container and, in the reverse direction of rotation, to close the same. This makes it easier for the user to hold the container or bottle in one hand and to open and close the second screw cap using the thumb and index finger of the same hand.

It has been found useful in such cases to place the plunger on the inside covering side of the second screw cap and a coupling sleeve forming the counterpart on the opposite side of the receptacle.

According to a preferred embodiment, the plunger is capable of rotation but engages the coupling sleeve immovably in the axial direction. However, it is obvious that, if necessary, a suitable thread pair can be provided between the plunger and the coupling sleeve, which contributes to the amount of displacement of the coupling sleeve relative to the first screw cap when the second screw cap is being screwed.

On the other hand, it may also be sufficient in some cases for the plunger and the coupling sleeve to engage by a force fit. However, if a thread pair is provided, a left-hand thread pair is preferred.

Advantageously, the receptacle has a coaxial rod extension forming the coupling sleeve as counterpart, and the outer periphery of the rod extension represents, at its base, with a coaxial through opening of corresponding diameter in the transverse wall of the first screw cap, the coaxial guide which in the initial screwing position of the second screw cap forms a further seal between the receptacle and the first screw cap.

Advantageously, on the top side of the receptacle and on the bottom side of the first screw cap there may be provided one or more additional seals which are in each case in the form of an annular gasket.

The first passageway can be provided in a retaining ring for the receptacle, which ring surrounds the receptacle and is connected thereto via the flexible apron, which permits relative movement between the axially movable receptacle and the retaining ring, which can be immovably attached to the inside circumferential surface of the first screw cap.

In addition, the sealing film or foil can be sealingly attached to an edge of the retaining ring facing the foil seal, if present, for the purpose of enclosing the ingredient to be mixed in in the receptacle and, upon said displacement of the receptacle by continued screwing of the second screw cap on the central union to the final screwed position, can be pierced by the knife edge jointly with the foil seal.

Depending on the axial distance between the sealing film or foil and the foil seal, the former may be pierced slightly in advance of the foil seal.

The other passageway may be formed by axial notches provided at intervals along the periphery of the rod extension of the coupling sleeve (the counterpart), which enter the region of the coaxial guide and thus begin to mate with the walls of the coaxial through opening in the first screw cap only when the second screw cap approaches its final screwed position when being screwed down.

Advantageously, the first screw cap displays an encircling flexible sealing lip above its female thread adapted for screwing onto the male thread of the container neck to bear against the rim of the neck initially still closed by the foil seal.

Preferably, the knife edge is serrated, at least over part of its periphery.

It has proven to be advantageous to provide the retaining ring in a bushing open to the container provided on the inside circumferential surface of the first screw cap and forming a part thereof, which is elastically expandable upon insertion of the retaining ring and has a catch to receive it.

The sealing lip can then be formed on the free edge of the bushing facing the container, and in addition, when the first screw cap is screwed onto the container for the purpose of remaining thereon, it can be expanded by said rim and can then be squeezed between said rim and the wall of the first screw cap.

It is advantageous for the second screw cap to have an internal collar which remains inside the central union after the second screw cap has been screwed onto the first screw cap and to have on its outside surface at least one encircling sealing lip adapted to form a seal against the inside wall of the central union. This ensures that the container's contents, after passing to the decanting opening, cannot be lost even partially to the environment by flowing past the second screw cap.

It is preferred for the second screw cap and the central union to comprise a left-hand thread pair.

The invention and its advantageous variants are explained in more detail below with reference to the exemplary embodiments illustrated in the figures of the drawing, in which.

Figure 1:
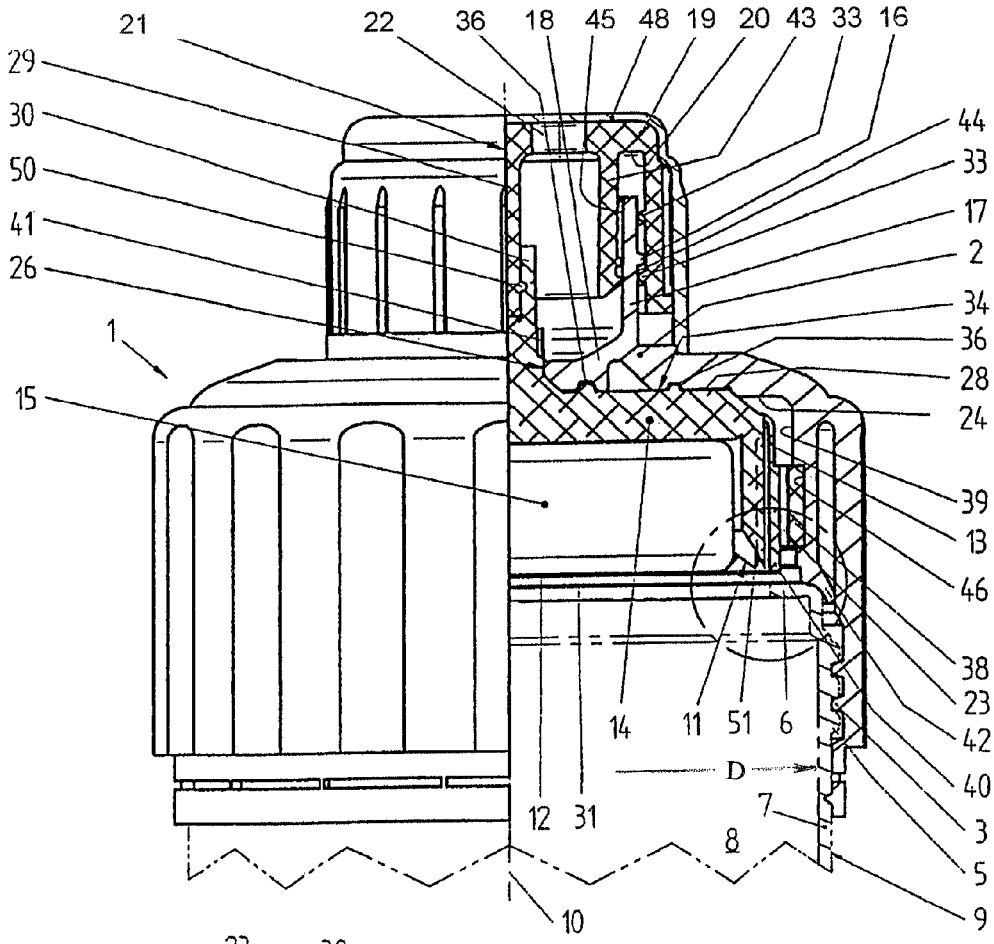
FIG. 1 is a side view of a closure of the invention in its initial screwing position, partly cut away.
Figure 3:
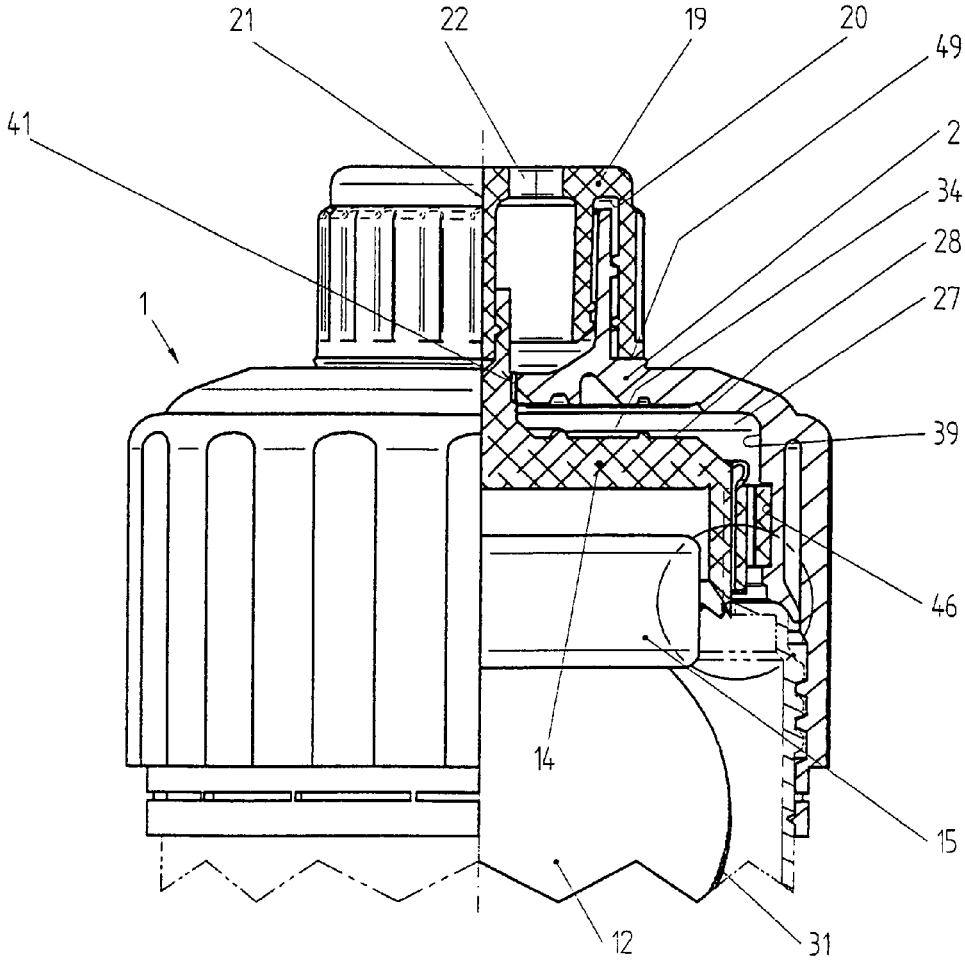
FIG. 3 is a side view corresponding to FIG. 1 of the closure in its final screwed position, in which the sealing film or foil and a foil seal present in this embodiment have been pierced.
Figure 5:
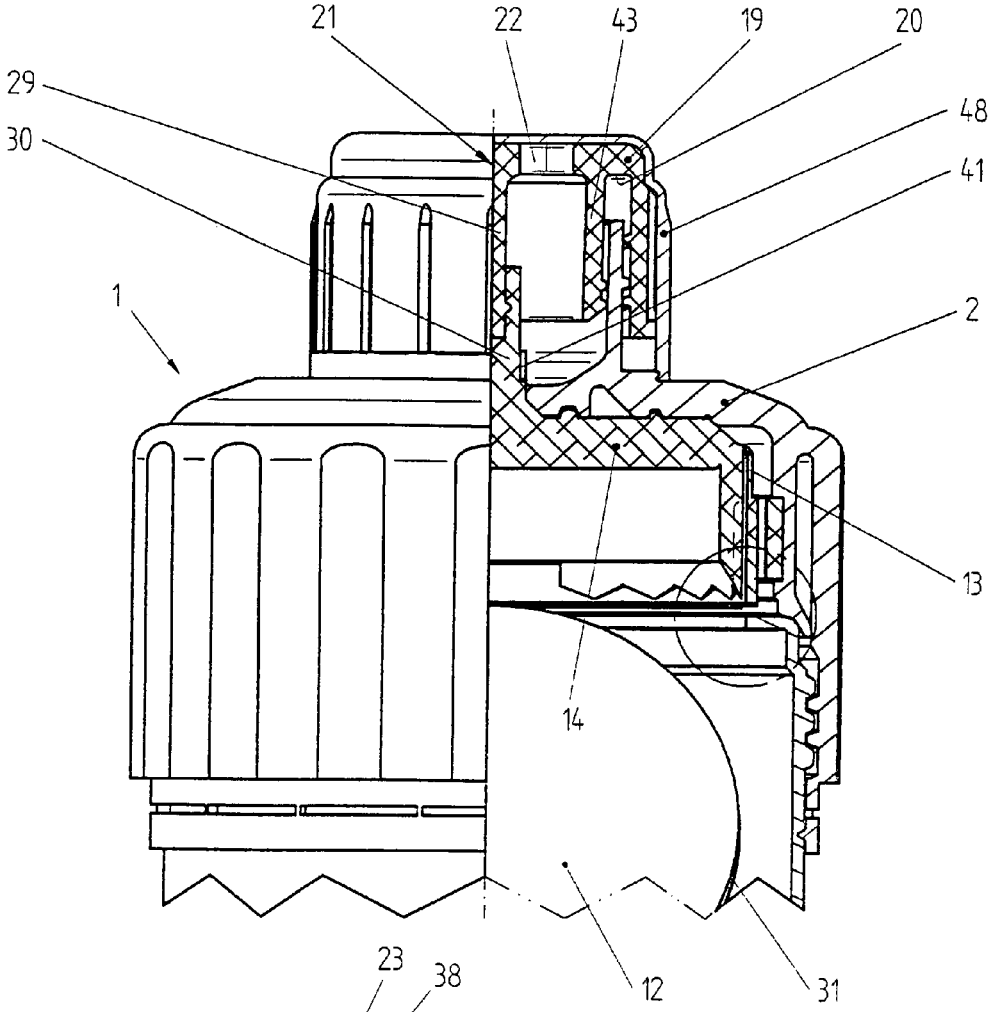
FIG. 5 is a side view corresponding to FIGS. 1 and 3 of the closure following the return of the second screw cap to its initial screwing position.
Figure 6:
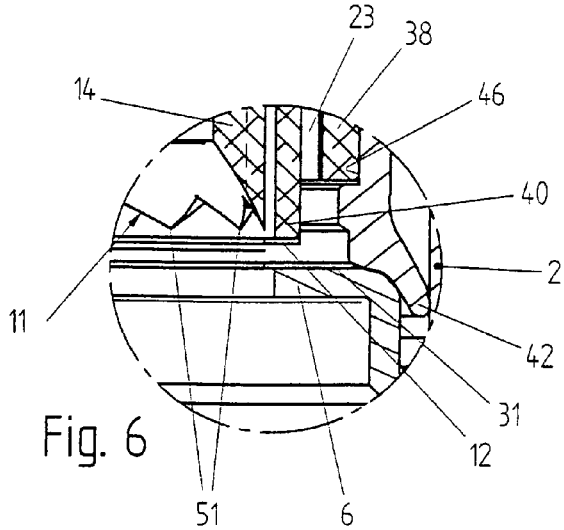
FIG. 6 is a detail of FIG. 5 on an enlarged scale.
Figure 7:
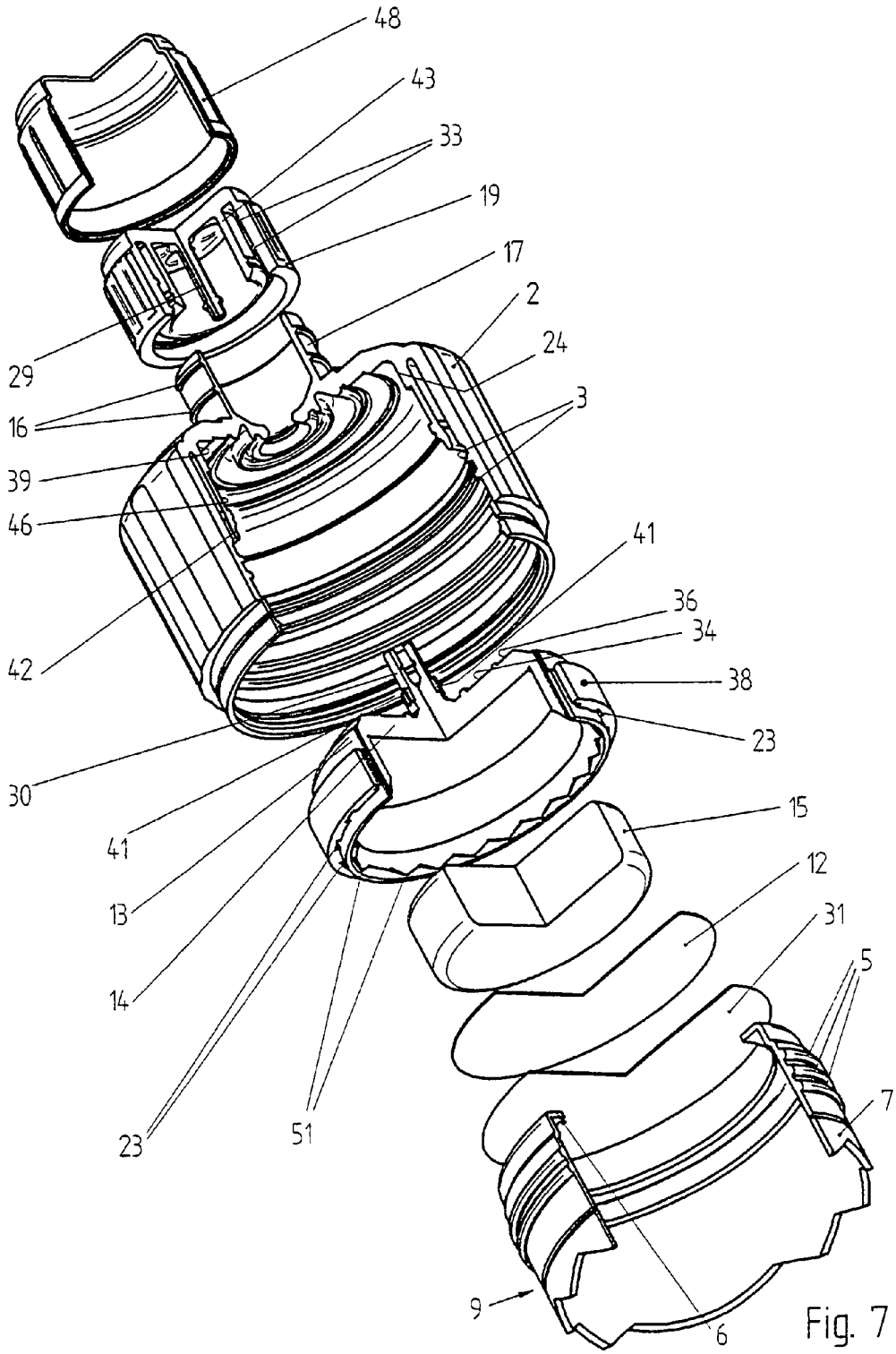
FIG. 7 is a perspective exploded view of the closure according to the previous figures as seen obliquely from below.
Figure 8:
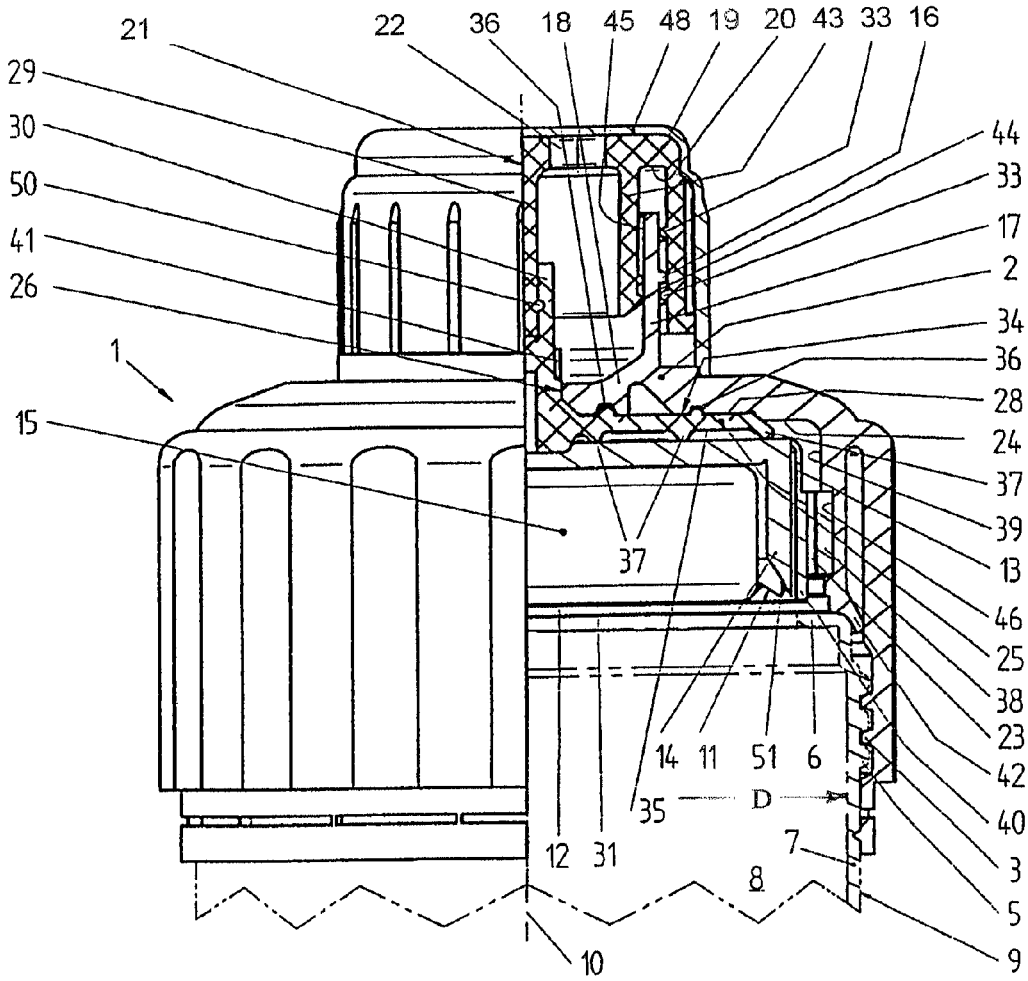
FIG. 8 is a side view corresponding to FIG. 1 of a second embodiment of the invention showing a two-part design of the receptacle and actuating means in their initial screwing position.
Figure 9:
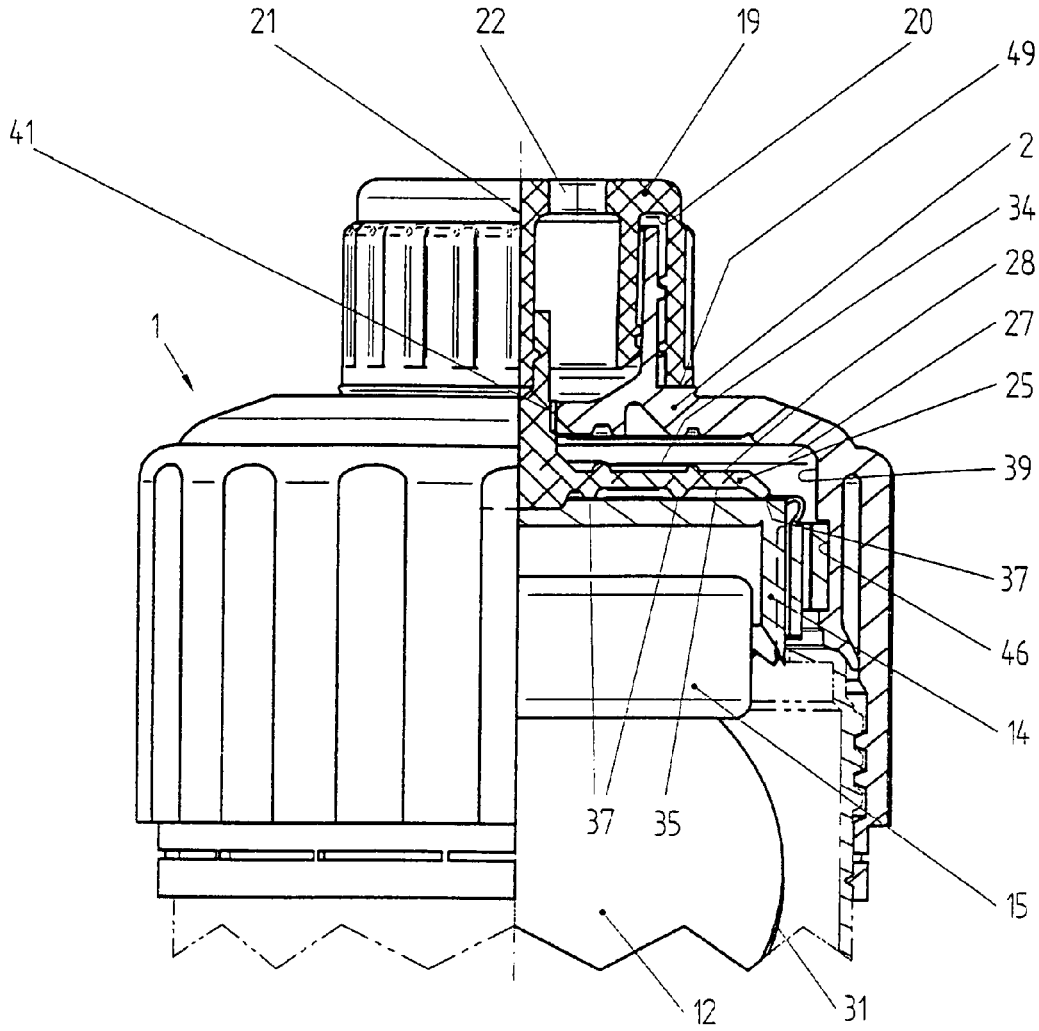
FIG. 9 is a side view of the second embodiment corresponding to FIG. 3.
Figure 10:
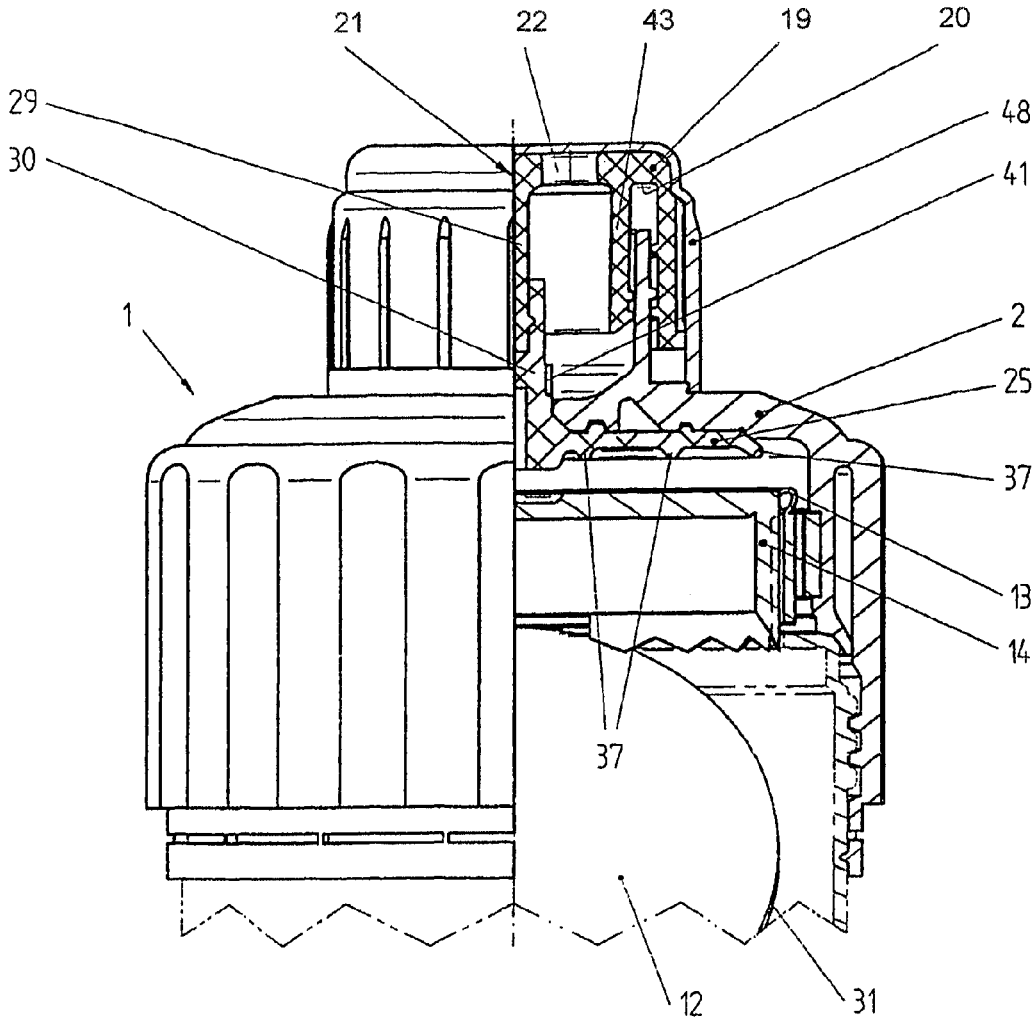
FIG. 10 is a side view of the second embodiment corresponding to FIG. 5 following the return of the second screw cap to its initial screwing position.
Figure 11:
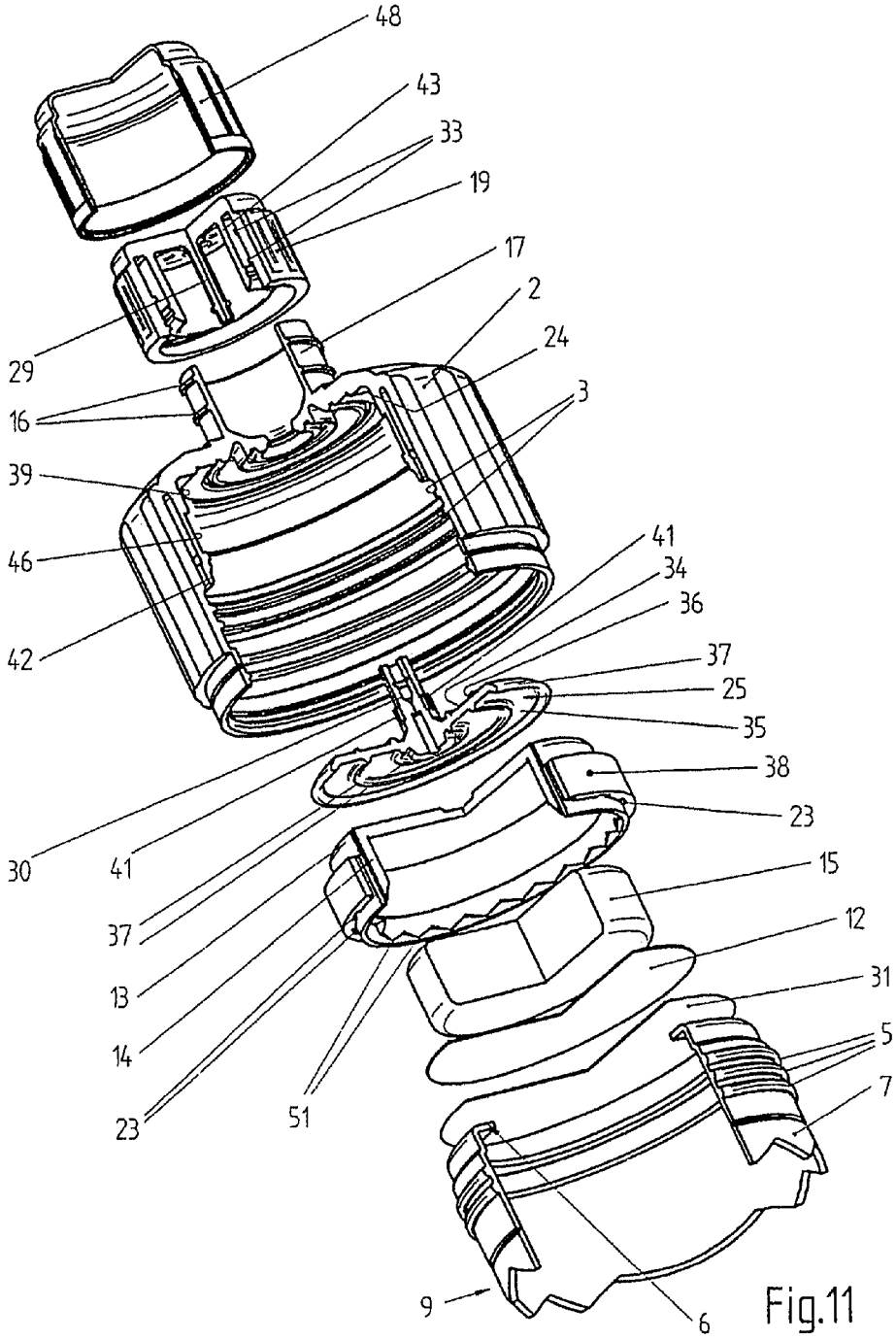
FIG. 11 is a perspective exploded view of the second embodiment corresponding to FIG. 7.

FIGS. 1, 3 and 5 show a closure 1 comprising a first screw cap 2, particularly of plastics material, which has a sleeve section 4 with a female thread 3 adapted for screwing onto a male thread 5 of a neck 7 of a container 9 having contents 8, particularly a bottle or the like of plastics material, glass or the like, which neck 7 has a rim 6.

The closure 1 has at least one knife edge 11 disposed in the region of the inside width of the neck 7 around a center axis 10 of the first screw cap 2 for severing a sealing film or foil 12 upon axial displacement of the at least one knife edge 11 through the sealing film or foil 12, said knife edge 11 being disposed on a receptacle 14 held centrally via a flexible apron 13 by the first screw cap 2 and movable relative to the first cap 2 toward the sealing film or foil 12, which receptacle 14 contains an ingredient 15 to be mixed into the contents 8 of the container 9.

Figure 2:
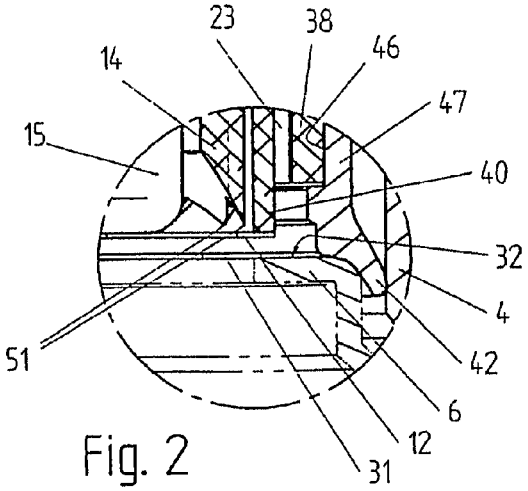
FIG. 2 is a detail of FIG. 1 on a larger scale.
Figure 4:
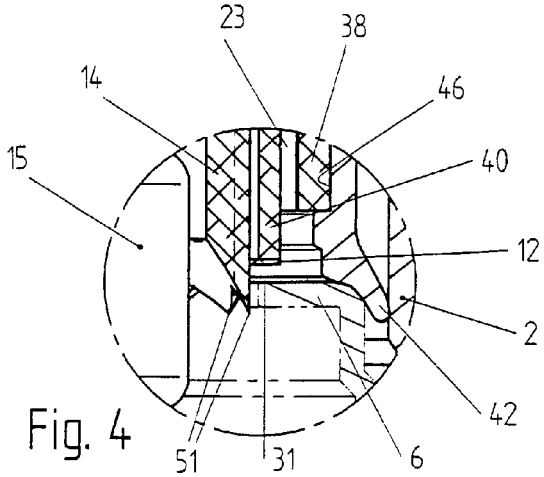
FIG. 4 is a detail of FIG. 3 on a larger scale.

In addition, a central union 17 having a male thread 16 on an upper transverse wall of the first screw cap 2 and a second screw cap 19 that can be screwed down onto, and unscrewed up from, the same with actuating means 21 disposed on its inside end wall 20, by means of which, when the second screw cap 19 is screwed on the central union 17, the receptacle 14 with its at least one knife edge 11 can be moved toward the sealing film or foil 12, this second screw cap 19 having an initial screwing position according to FIGS. 1 and 2, in which the sealing film or foil 12 is still intact and, after continued screwing, a final screwed position, as shown in FIGS. 3 and 4, in which the sealing film or foil 12 has been pierced by at least one knife edge 11.

According to the invention:

a) the first screw cap 2 remains permanently on the neck 7 of the bottle 9 after it has been screwed on, b) the second screw cap 19 has a decanting and/or drinking opening 22 of the sports cap type, c) at least one first axial passageway 23 for the contents 8 of the bottle is provided radially between the first screw cap 2 and the receptacle 14 as soon as the latter has been opened by destruction of the sealing film or foil 12;

d) the receptacle 14 is guided in a sliding manner centrally in a coaxial guide 26 in the transverse wall 18 of the first screw cap 2, which initially bears axially against a substantially radial inside surface 24 of the first screw cap 2, providing, by bearing against the first screw cap 2, a seal between the container 9 and the second screw cap 19 and thus the environment and, upon its movement concentrically relatively to the sealing film or foil 12 to an end position, is capable of severing this sealing film or foil 12 with its at least one knife edge 11, in which end position (FIGS. 3 and 4) the sealing film or foil 12 has been at least partially severed, the ingredient 15 to be mixed in has been released into the contents 8 of the bottle and another passageway 27 (FIGS. 3 and 4) has been opened between the receptacle 14 and the first screw cap 2, e) the second screw cap 19, on its inside covering surface, and the receptacle 14, on its end face 28 opposite thereto, together comprise, as actuating means 21, a concentric connecting pair consisting of a plunger 29 and a counterpart 30 mating therewith, which interengage axially immovably, the plunger 29 and its counterpart 30 being axially positioned relatively to each other such that, by said continued screwing of the second screw cap 19 on the central union 17 to its final screwed position, the container's contents 8 can be released to flow to the second screw cap 19 and its decanting and/or drinking opening 22, this being achieved by the receptacle 14 moving, during such continued screwing, toward the sealing film or foil 12 to break the seal between it and the first screw cap 2 and pierce the sealing foil with its at least one knife edge 11, and f) when the second screw cap 19 is turned in the reverse direction, i.e., back to its initial screwing position, the receptacle 14 can be moved by the actuating means 2 back to its sealing position against the first screw cap 2 such that the passageway to the second screw cap 19 and its decanting opening is again blocked.

In the final screwed position, the sealing film or foil 12 has been at least partially severed, the ingredient 15 to be mixed into the bottle's contents 8 has been released and a second passageway 27 for the container's contents 8 has been opened. In the embodiment shown, the neck 7 of the container 9 is initially hermetically sealed by means of a foil seal 31 sealingly attached to a circular sealing area 32 (FIG. 2) on the rim 6 of the neck 7. When the second screw cap 19 is moved to its final screwed position, the foil seal 31, like the sealing film or foil 12, is pierced, as clearly shown in FIGS. 3 and 4, in order to release the container's contents 8.

A design of the knife edge 11 is preferred which does not cause complete severing of the sealing film or foil 12 and possibly of the foil seal 31 but rather ensures that these foils remain intact at some point on their circumference such that they are only bent downwardly into the container, as is clearly shown in, say, FIGS. 3 and 5, in which case the passageway formed must naturally be large or wide enough for the ingredient 15, here in the form of a tablet, to drop into the container 9 and its contents 8.

The male thread 16 on the central union 17 preferably forms a quick thread 16, 33 with the thread 33 of the second screw cap 19 such that less than one turn of the second screw cap 19 is necessary to open the container 9 in one direction of rotation and to re-close the same in the other direction of rotation.

In the embodiment shown, the plunger 29 is disposed centrally on the inside of the second screw cap 19 and the coupling sleeve 30 centrally on the opposite side of the receptacle 14.

The plunger 29 can be axially locked in position in the coupling sleeve 30 but is free for rotation therein, cf. catch 50.

Alternatively, the plunger 29 and the coupling sleeve 30 may be mutually force-fitted.

It would also be possible for the plunger 29 and coupling sleeve 30 to be connected by a thread pair.

On the back 34 of the receptacle 14, the counterpart 30 is formed by a coupling sleeve-forming coaxial rod extension, whose outer circumference at its base represents the coaxial guide 26 with a coaxial through opening of corresponding diameter in the traverse wall 18 of the first screw cap 2, which in the initial screwing position of the second screw cap 19 forms a seal between the receptacle 14 and the first screw cap 2, which in the initial screwing position of the second screw cap 19 forms a seal between the receptacle 14 and the first screw cap 2.

On the back 34 of the receptacle 14 several additional seals 36 and 37 are provided which in each case can be caused to bear against the first screw cap 2 in the form of an annular gasket.

The first passageway 23 is provided in a retaining ring 38 for the receptacle 14, which retaining ring surrounds the receptacle 14 and is connected thereto via the flexible apron 13, which permits a relative movement between the axially movable receptacle 14 and the retaining ring 23 which can be immovably attached to the inside circumference 39 of the first screw cap 2.

The sealing film or foil 12 is sealingly attached to an edge 40 of the retaining ring 23 facing the foil seal 31 for the purpose of enclosing the ingredient 15, advantageously in the form of a tablet, on the receptacle 14, which sealing film or foil 12, upon said movement of the receptacle 14, may be severed by the knife edge 11 of said receptacle 14 just in advance of the foil seal 31.

The third passageway is formed by notches 41 provided at intervals on the periphery of an attachment on the coupling sleeve 30, which move into the region of the coaxial guide 26 and thus mate with the walls of the coaxial through opening of the first screw cap 2 only when the second screw cap 10 approaches its final screwed position shown in FIG. 3 as it is being screwed down.

The first screw cap 2 has an encircling flexible sealing lip 42 above its female thread 3 adapted for screwing onto the male thread 5 on the neck 7 of the container 9 to bear against the rim of the neck initially closed by the foil seal 31. Cf. FIG. 2.

As the figures illustrate, in the embodiment shown the knife edge 11 is serrated, at least over part of its periphery, in the present case with individual tips 51, which facilitate severing of the sealing film or foil 12 and the foil seal 31.

Advantageously, the retaining ring 38 is affixed in a bushing 47 open to the container and provided inside the first screw cap 2 and forming a part thereof, which is elastically expandable upon insertion of the retaining ring 38 and has a catch 46 to receive it.

The sealing lip 42 is formed on the free edge of the bushing 47 facing the container 9. The sealing lip 42 is capable of being expanded by the rim 6 when the first screw cap 2 is screwed onto the container 9 for the purpose of remaining thereon and can then be caught between the rim 6 and the wall of the first screw cap 2 and be squeezed to cause a sealing effect.

The second screw cap 19 has an internal collar 43 which remains inside the union 17 after the second screw cap 19 has been screwed onto the first screw cap 2 and has on its outside surface at least one encircling sealing lip 44 adapted to form a seal against the inside wall 45 of the union 17.

Advantageously, the second screw cap 19 and the union 17 have a left-hand thread pair 16, 33, since it is customary to open a screw cap of, say, a drinking bottle by turning it to the left.

The closure functions as follows:

First of all, a transparent plastic cap 48, shown in FIG. 1 as the tamper-evident seal, is torn off. In order to open the container or bottle 9, the second screw cap 19 is turned to the left until the stop 49, as shown in FIG. 3, is reached. During this movement, the plunger 29 and the coupling sleeve 30 move the receptacle 14 to the opening position shown in FIG. 3 as a result of the left-hand thread of the second screw cap 19. The knife edge 11 has now pierced the sealing film or foil 12 and the foil seal 31 with its tooth tips; both films or foils are bent downwardly into the container 9 or bottle and permit the tablet 15 to drop into the container's contents 8 and dissolve therein. The container's contents 8 can then pass through the passageway 23 (first passageway), of which several are provided, distributed inside the container ring 38, and pass between the end face 34 or the back of the receptacle 14 (second passageway 27) and further through the notches 41 (third passageway) and then through the decanting and/or drinking opening 22.

When the container 9 or bottle is re-closed, the second screw cap 19 is screwed right back to its initial position, shown in FIG. 5, during which movement the receptacle 14 is entrained and comes to bear sealingly against the end face 24 of the first screw cap 2. The notches 41 also move back up as shown in FIG. 3 such that the third passageway at the coaxial guide 26 opened previously is closed again.

The second embodiment of the invention is illustrated in FIGS. 8 to 11, and FIGS. 2, 4, and 6 also pertain thereto. The same parts are given the same reference numerals as in the first variant.

In this embodiment, the receptacle 14 and the actuating means 21 form separate units.

In this case, an axial intermediate piston 25, having a bottom side 35, is provided between the first screw cap 2 and the receptacle 14 bearing against a substantially radial inside surface 24 of the first screw cap 2 and guided for movement in a coaxial guide 26 in the transverse wall 18 of the first screw cap 2. This intermediate piston 25 is capable, on the one hand because it bears against the first screw cap 2, of sealing the container 9 or the bottle against the escape of contents in the direction of the second screw cap 19 and its decanting or drinking opening 22, and on the other hand when it is moved or displace jointly with the receptacle 14, of moving the same and its at least one knife edge 11 concentrically relatively to the sealing film or foil 12 for the purpose of severing the same in a final screwed position (FIGS. 3 and 4).

To this extent the function of the second embodiment corresponds to that of the first embodiment.

A difference in the function of these two embodiments consists in that when the second screw cap 2 is unscrewed back to its initial screwing position for the purpose of reclosing, the receptacle 14 is no longer entrained by the intermediate piston 25 but rather can remain in position.

It has proven to be advantageous to provide one or more gaskets on the top side and possibly also on the bottom side 35 of the intermediate piston 25 which can each be in the form of an annular gasket bearing against the first screw cap 2 and against the receptacle 14 respectively.

The invention claimed is:

1. A closure for a container having contents, particularly a container made of plastics material or glass, comprising a first screw cap particularly of plastics material, to be sealingly connected to a neck of said container, which neck has a rim, and comprising at least one knife edge disposed in a region of an inside width of said neck around a center axis of said first screw cap for severing a sealing film or foil upon axial displacement of said at least one knife edge through said sealing film or foil, which knife edge is disposed on a receptacle held substantially centrally by said first screw cap via a flexible apron and is movable relatively to said first screw cap toward said sealing film or foil, which receptacle contains an ingredient to be mixed with the contents of said container, and further comprising a central union, having a male thread, on an upper transverse wall of said first screw cap and a second screw cap that can be screwed down onto, and unscrewed up from, the same by means of actuating means disposed on its inside end face, by means of which, when said second screw cap is screwed onto said central union, said receptacle with its at least one knife edge can be moved toward said sealing film or foil, which second screw cap has an initial screwing position in which said sealing film or foil is still intact and, after continued screwing, a final screwed position in which said sealing film or foil has been pierced by said at least one knife edge, characterized in that a) said first screw cap remains on said neck of said container after it has been sealingly connected thereto, b) said second screw cap has a decanting and/or drinking opening of a sports cap type, c) at least a first axial passageway for the contents of said container is provided radially between said first screw cap and said receptacle, d) said receptacle is guided in a sliding manner centrally in a coaxial guide in a transverse wall of said first screw cap, which initially bears axially against a substantially radial inside surface of said first screw cap, said receptacle, by bearing against said first screw cap, providing a seal between said container and said second screw cap and thus an environment, and when it moves with its at least one knife edge concentrically relatively to said sealing film or foil to an end position, it is capable of severing said sealing film or foil, and in this end position said sealing film or foil has been at least partially severed, said ingredient to be mixed in has been released into the contents of said container, and a second passageway has been opened between said receptacle and said first screw cap, e) said second screw cap, on its inside covering surface, and said receptacle, on its end face opposite thereto, together comprise, as actuating means, a concentric connecting pair consisting of a plunger and a counterpart mating therewith, which interengage axially immovably, said plunger and its counterpart being positioned axially relatively to each other such that, by said continued screwing of said second screw cap on said central union to the final screwed position, said container's contents can be released to flow to said second screw cap and its decanting and/or drinking opening, this being achieved by said receptacle being moved, during such continued screwing, toward said sealing film or foil to cause said at least one knife edge to pass through said sealing foil or film to break said seal between it and said second screw cap, f) when said second screw cap is turned in a reverse direction, i.e., back to its initial screwing position, said receptacle can be moved by said actuating means back to its sealing position against said first screw cap such that a route to said second screw cap and its decanting opening is again blocked.

2. A closure for a container having contents, particularly a container or the like made of plastics material or glass, comprising a first screw cap, particularly of plastics material, to be sealingly connected to a neck of said container, which neck has a rim, and comprising at least one knife edge disposed in a region of an inside width of said neck around a center axis of said first screw cap for severing a sealing film or foil upon axial displacement of said at least one knife edge through said sealing film or foil, which knife edge is disposed on a receptacle held substantially centrally by said first screw cap via a flexible apron and is movable relatively to said first screw cap toward said sealing film or foil, which receptacle contains an ingredient to be mixed with the contents of said container, and further comprising a central union, having a male thread, on an upper transverse wall of said first screw cap and a second screw cap that can be screwed down onto, and unscrewed up from, the same by means of actuating means disposed on its inside end face, by means of which, when said second screw cap is screwed onto said central union, said receptacle with its at least one knife edge can be moved toward said sealing film or foil, which second screw cap has an initial screwing position, in which said sealing film or foil is still intact and, after continued screwing, a final screwed position, in which said sealing film or foil has been pierced by said at least one knife edge, characterized in that a) said first screw cap remains permanently on said neck of said container after it has been sealingly connected thereto, b) said second screw cap has a decanting and/or drinking opening of a sports cap type, c) at least a first passageway for the contents of said container is provided radially between said first screw cap and said receptacle, d) an axial intermediate piston is centrally provided initially bearing against a substantially radial inside surface of said first screw cap between said first screw cap and said receptacle and is movably guided in a coaxial guide in a transverse wall of said first screw cap, which intermediate piston is capable, by bearing against said cap first screw cap, of forming a seal between said container and said second screw cap and thus an environment, and on the other hand as it moves jointly with said receptacle, of moving the same and its at least one knife edge concentrically relatively to said sealing film or foil to an end position for the purpose of severing said sealing film or foil, in which end position said sealing film or foil has been at least partially severed, said ingredient has been released into said container's contents, and a second passageway between said intermediate piston and said cap first screw has been opened, e) said, second screw cap on its inside covering surface, and said intermediate piston, on its end face opposite thereto, together comprise, as actuating means, a concentric connecting pair consisting of a plunger and a counterpart mating therewith, which interengage axially immovably, said plunger and its counterpart being positioned axially relatively to each other such that, by said continued screwing of said second screw cap on said central union to the final screwed position, the container's contents can be released to flow to said second screw cap and its decanting and/or drinking opening, this being achieved by said intermediate piston being moved, during such continued screwing, toward said sealing film or foil to break the seal between it and said first screw cap and thus to cause said at least one knife edge to pass through said sealing foil or film, and f) when said second screw cap is turned in a reverse direction, i.e., back to its initial screwing position, said intermediate piston can be moved by said actuating means back to its sealing position against said first screw cap such that a route to said second screw cap and its decanting opening again blocked.

3. The closure as defined in claim 1,
characterized in that
said first screw cap has a sleeve section, having a female thread and adapted to screw onto a male thread on a neck of a container, which neck has a rim.

4. The closure as defined in claim 1,
characterized in that
said neck of said container may initially be hermetically sealed by a foil seal which has been sealingly attached to a circular sealing surface on said rim of said neck and which upon movement of a second screw cap to its final screwed position, like said sealing film or foil, is pierced by at least one knife edge on said receptacle.

5. The closure as defined in claim 3,
characterized in that
said male thread on said central union forms a quick thread with a thread of said second screw cap such that less than one turn of said second screw cap, in one direction of rotation, is necessary to open said container and, in the reverse direction of rotation, to close the same.

6. The closure as defined in claim 1,
characterized in that
said plunger is disposed on the inside covering side of said second screw cap and a coupling sleeve forming said counterpart is disposed on an opposite side of said receptacle.

7. The closure as defined in claim 1,
characterized in that
said plunger is rotatably but axially immovably locked in a coupling sleeve.

8. The closure as defined claim 1,
characterized in that
said plunger and a coupling sleeve are mutually force-fitted.

9. The closure as defined in claim 1,
characterized in that
said plunger and a coupling sleeve comprise a thread pair.

10. The closure as defined in claim 1,
characterized in that
said receptacle has a coaxial rod extension forming a coupling sleeve as counterpart, and an outer periphery of said rod extension represents, at its base, with a coaxial through opening of corresponding diameter in a transverse wall of said first screw cap, said coaxial guide, which in the initial screwing position of said second screw cap forms a further seal between said receptacle and said first screw cap.

11. The closure as defined in claim 2,
characterized in that
said intermediate piston has a coaxial rod extension forming a coupling sleeve as counterpart, and an outer periphery of said rod extension represents, at its base, with a coaxial through opening of corresponding diameter in a transverse wall of said first screw cap, said coaxial guide, which in the initial screwing position of said second screw cap forms a further seal between said intermediate piston and said first screw cap.

12. The closure as defined in claim 10,
characterized in that
one or more further seals are provided on a top side of said receptacle and on a bottom side of said first screw cap which can each be in the form of an annular gasket.

13. The closure as defined in claim 11,
characterized in that
one or more seals are provided on a top side and on a bottom side of said intermediate piston which can each be in the form of an annular gasket bearing against said first screw cap and against said receptacle respectively.

14. The closure as defined in claim 1,
characterized in that
said first passageway can be provided in a retaining ring for said receptacle, which ring surrounds said receptacle and is connected thereto via said flexible apron, which permits relative movement between said axially movable receptacle and said retaining ring, which can be immovably attached to an inside circumferential surface of said first screw cap.

15. The closure as defined in claim 1,
characterized in that
said sealing film or foil can be sealingly attached to an edge of a retaining ring facing said foil seal, if present, for the purpose of enclosing said ingredient to be mixed in said receptacle and, upon a displacement of said receptacle by continued screwing of said second screw cap on said central union to the final screwed position, can be pierced by said knife edge jointly with said foil seal.

16. The closure as defined in claim 1,
characterized in that
said sealing film or foil may be pierced slightly in advance of said foil seal.

17. The closure as defined in claim 10,
characterized in that
an other passage way is formed by axial notches provided at intervals along a periphery of said rod extension of said coupling sleeve, which enter a region of said coaxial guide and thus begin to mate with walls of the coaxial through opening in said first screw cap only when said second screw cap approaches its final screwed position when being screwed down.

18. The closure as defined in claim 3,
characterized in that
said first screw cap displays an encircling flexible sealing lip above its female thread adapted for screwing onto said male thread of said container neck to bear against said rim of said neck initially still closed by said foil seal.

19. The closure as defined in claim 1,
characterized in that
said knife edge is serrated, at least over part of its periphery.

20. The closure as defined in claim 14,
characterized in that
said retaining ring is provided in a bushing open to said container provided on the inside circumferential surface of said first screw cap and forming a part thereof, which is elastically expandable upon insertion of said retaining ring and has a catch to receive it.

21. The closure as defined in claim 18,
characterized in that
said sealing lip is formed on a free edge of a bushing facing said container.

22. The closure as defined in claim 18,
characterized in that
when said first screw cap is screwed onto said container for the purpose of remaining thereon, it can be expanded by said rim and can then be squeezed between said rim and a wall of said first screw cap.

23. The closure as defined in claim 1,
characterized in that
said second screw cap has an internal collar which remains inside said central union after said second screw cap has been screwed onto a first screw cap and has on its outside surface at least one encircling sealing lip adapted to form a seal against the inside wall of said central union.

24. The closure as defined in claim 1,
characterized in that
said second screw cap and said central union comprise a left-hand thread pair.

* * * * *